US005329983A

United States Patent [19]

Cook

[11] Patent Number: 5,329,983

[45] Date of Patent: * Jul. 19, 1994

[54] SEALED CHAMBER DIE CASTINGS OF METAL MATRIX COMPONENTS

[75] Inventor: Arnold J. Cook, 372 N. Craig St., Pittsburgh, Pa. 15213

[73] Assignee: Arnold J. Cook, Pittsburgh, Pa.

[ * ] Notice: The portion of the term of this patent subsequent to Feb. 2, 2010 has been disclaimed.

[21] Appl. No.: 773,192

[22] Filed: Oct. 8, 1991

[51] Int. Cl.[5] ..... B22D 19/14

[52] U.S. Cl. ..... 164/97; 164/61; 164/137; 164/337

[58] Field of Search ..... 164/61, 63, 66.1, 68.1, 164/97, 113, 119, 259, 141, 284, 337, 127, 461, 335, 137

[56] References Cited

U.S. PATENT DOCUMENTS

| | | | |
|---|---|---|---|
| 3,547,180 | 12/1970 | Cochran | 164/119 |
| 3,677,332 | 7/1972 | Smiernow | 164/63 |
| 4,205,717 | 6/1980 | Smith | 164/335 |
| 4,340,109 | 7/1982 | Roddy | 164/113 |
| 4,995,444 | 2/1991 | Jolly | 164/97 |
| 5,113,925 | 5/1992 | Cook | 164/97 |
| 5,183,096 | 2/1993 | Cook | 164/97 |

FOREIGN PATENT DOCUMENTS

| | | | |
|---|---|---|---|
| 2249537 | 4/1974 | Fed. Rep. of Germany | 164/97 |
| 59-76657 | 5/1984 | Japan | 164/63 |
| 63-192830 | 8/1988 | Japan | 164/97 |
| 63-242462 | 10/1988 | Japan | 164/97 |
| 1-113162 | 5/1989 | Japan | 164/97 |

*Primary Examiner*—P. Austin Bradley
*Assistant Examiner*—Rex E. Pelto
*Attorney, Agent, or Firm*—Ansel M. Schwartz

[57] ABSTRACT

The present invention pertains to an apparatus for casting which includes a melt chamber within which a metal is disposed. The melt chamber includes means for melting the material. A mold chamber is disposed beneath the melt chamber comprised of a mold defining a mold cavity within which the metal is formed and a preform is disposed. There is also a riser cavity fluidically connected to the mold cavity for holding a charge of melted metal. There is also provided means for fluidically connecting the melt chamber to the mold chamber and a valve element for controlling the flow of metal through the connecting means such that when the connecting means is opened, the chambers are fluidically connected and when the connecting means is closed, the chambers are fluidically isolated. The mold chamber has means for evacuating the mold chamber and means for pressurizing the mold chamber such that the melted metal disposed within the riser cavity is forced into the preform. In a preferred embodiment, the mold is comprised of separable mold halves and there are included, within the mold chamber, means to mechanically separate the mold halves such that the metal is ejected therefrom. In a preferred embodiment, the bottom of the mold halves are thermally connected to a water cooled chill member for directionally solidifying the melted metal.

31 Claims, 8 Drawing Sheets

SEALED CHAMBER DIE CASTINGS OF METAL MATRIX COMPONENTS

FIELD OF THE INVENTION

The present invention is related to casting. More specifically, the present invention is related to an apparatus and method for casting metal matrix composites quickly and efficiently.

BACKGROUND OF THE INVENTION

Metal matrix composites (MMC) comprising a metal matrix and a reinforcing phase such as ceramic particulates, show great promise for a variety of applications because they combine the stiffness and wear resistance of the reinforcing phase with the ductility and toughness of the metal matrix.

Various metallurgical processes have been described for the fabrication of metal matrix composites. These methods are, for instance, based on powder metallurgy techniques and liquid metal infiltration techniques which make use of pressure casting, vacuum casting, stirring and wetting agents. Pressure Infiltration Casting as described in U.S. patent application Ser. No. 07/325,221 by Arnold J Cook and entitled "Method and Apparatus for Casting" described pressure casting apparatus whereby the mold, metal and heating means are contained within a pressure vessel. The described method for casting essentially comprises the steps of evacuating the pressure vessel while melting the metal within a crucible. The mold, comprising a preform, has a snorkel and is disposed on top of the crucible. The molten metal is fluidically connected to the mold by disposing the snorkel in the crucible of molten metal, thereby isolating the inside of the mold from the interior of the pressure vessel. Inert pressurized gas is then used to pressurize the vessel thereby forcing the molten metal into the mold. Since the mold is contained within a pressure vessel, the pressure acts on the outside of the mold and the inside of the mold. By controlling the rate of pressurization, the forces on the inside and the outside of the mold can be essentially balanced such that a thin walled mold can be used.

Previous methods of forming metal matrix components have been slow and tedious. The present invention describes an apparatus which decreases the time of production runs by using a novel combination of elements including separate melt and mold chambers and separable mold halves to eject the metal matrix component from within.

SUMMARY OF THE INVENTION

The present invention pertains to an apparatus for casting which includes a melt chamber within which a metal is disposed. The melt chamber includes means for melting the material. A mold chamber is disposed beneath the melt chamber comprised of a mold defining a mold cavity within which the metal is formed and a preform is disposed. There is also a riser cavity fluidically connected to the mold cavity for holding a charge of melted metal. There is also provided means for fluidically connecting the melt chamber to the mold chamber and a valve element for controlling the flow of metal through the connecting means such that when the connecting means is opened, the chambers are fluidically connected and when the connecting means is closed, the chambers are fluidically isolated. The mold chamber has means for evacuating the mold chamber and means for pressurizing the mold chamber such that the melted metal disposed within the riser cavity is forced into the preform.

In a preferred embodiment, the mold is comprised of separable mold halves and there are included, within the mold chamber, means to mechanically separate the mold halves such that the metal is ejected therefrom.

In a preferred embodiment, the bottom of the mold halves are thermally connected to a water cooled chill member for directionally solidifying the melted metal.

In a more preferred embodiment, the melt chamber is rotatably connected to a swing pole such that a plurality of melt chambers can swing into engagement with the mold chamber. In this arrangement, the preform can be loaded into the mold cavity or a preform chamber can be rotatably attached to the swing pole similarly to the melt chambers. The preform chamber contains a liquid mixture of reinforcement material which is transported to the mold chamber through the connecting means. This mixture is then heated to form a preform. Alternatively, the preform mixture can be injected from a preform chamber which is fixedly attached to the mold chamber such that a preform passage feeds directly into the riser cavity.

The present invention also relates to a method for the production of metal matrix composites. Initially, there is the step of loading a melt chamber with a metal. Next, there is the step of evacuating the melt chamber and a mold chamber disposed between the melt chamber. The mold chamber includes a mold defining a mold cavity within which the metal is formed and a preform is disposed, and a riser cavity fluidically connected to the mold cavity for holding a charge of metal. Then, there is the step of melting the metal with the melt chamber. Then, there is the step of fluidically connecting the melt chamber to the mold chamber with a valve element such that the melted material flows through the valve element and into the riser cavity. Then, there is the step of fluidically sealing the melt chamber. Next, there is the step of pressurizing the mold chamber such that the melted metal is forced into the preform. Then, there is the step of removing the metal from the mold. In a preferred embodiment, the mold is comprised of separable mold halves and the removing step includes the step of separating the mold halves with separating means such that the metal is ejected from the mold halves.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 1:
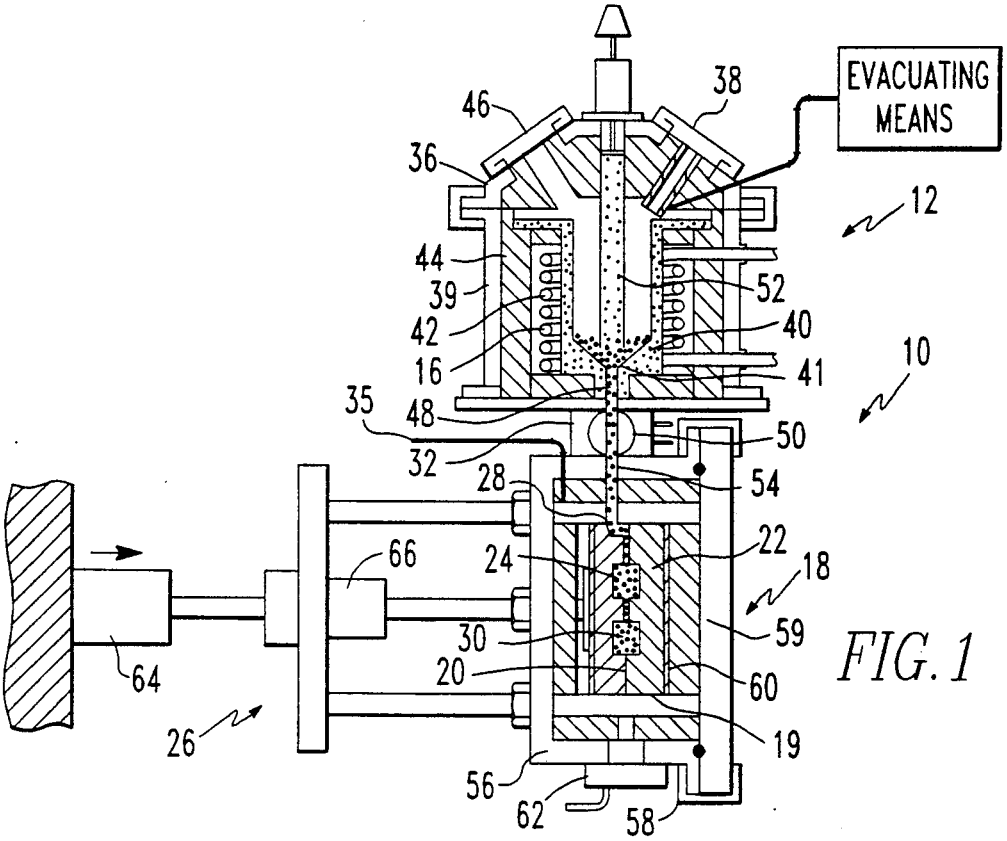
FIG. 1 shows a partial cross sectional view of the apparatus for casting.

Referring now to the drawings wherein like reference numerals refer to similar or identical parts throughout the several views, and more specifically to FIG. 1 thereof, there is shown an apparatus 10 for casting. The apparatus 10 comprises a melt chamber 12. A metal 14 is disposed within the melt chamber 12. The melt chamber 12 further comprises means 16 for melting the metal 14. Disposed below the melt chamber 12 is a mold chamber 18. The mold chamber 18 contains a mold 19 which defines a mold cavity 24 for forming the melted metal 14. A riser cavity 28 is provided, preferably above the mold cavity 24, for holding a charge of melted metal 14 prior to pressurization. Disposed within the mold cavity 24 is a preform 30 for reinforcing the metal 14.

The apparatus 10 further includes means 32 for fluidically connecting the chambers 12, 18 and preferably a valve element 50 disposed in the fluidic connecting means 32 for controlling the flow of melted metal from the melt chamber 12 such that when the valve element 50 is opened, the chambers 12, 18 are fluidically connected and when the valve element 50 is closed, the chambers 12, 18 are fluidically isolated.

Figure 2:
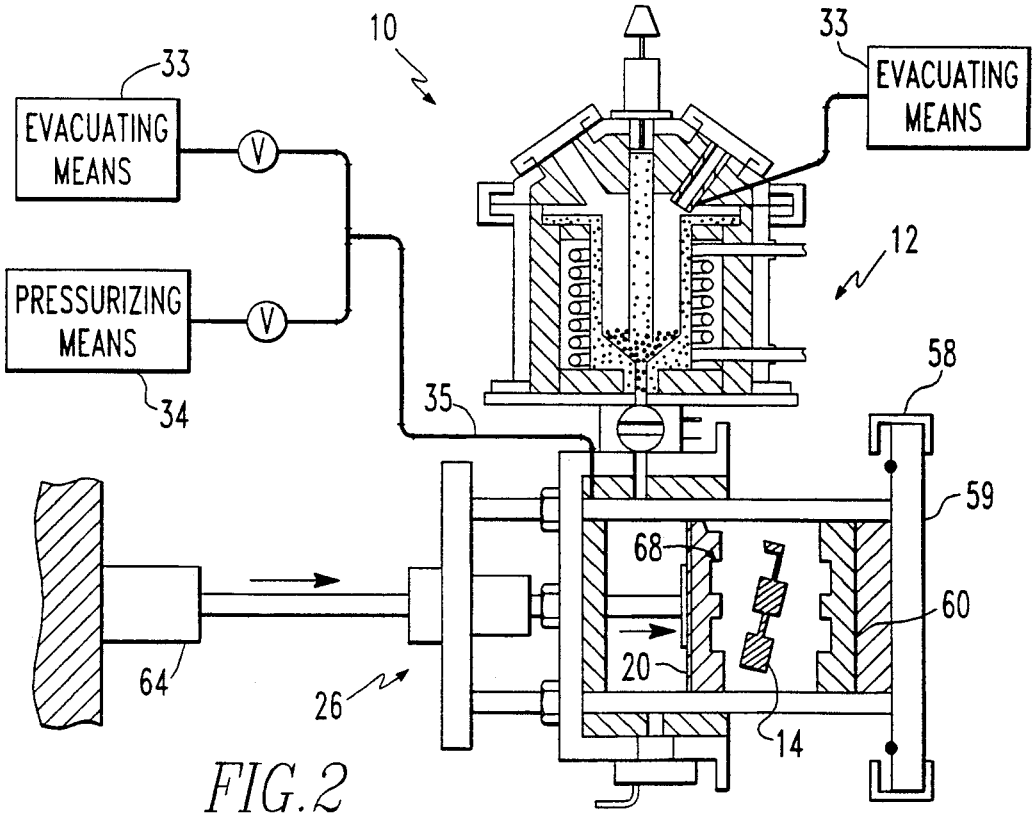
FIG. 2 shows a partial cross sectional of the apparatus for casting with the cast metal being removed from the separable mold halves.

As shown in FIG. 2, the apparatus 10 also comprises means 33 for evacuating the mold chamber 18 and means 34 for pressurizing the mold chamber 18 such that melted metal 14 disposed within the riser cavity 28 is forced into the preform 30. Preferably, the evacuation means 33 and the means for pressurizing 34 are fluidically connected to a common port 35. Preferably, the mold 19 is comprised of separable mold halves 20, 22 and the mold chamber 18 comprises means 26 to mechanically separate the mold halves 20, 22 such that the metal and preform within the mold cavity are ejected therefrom.

In a preferred embodiment, the melt chamber 12 comprises a water cooled melt pressure vessel 36. The metal 14, such as aluminum, is loaded through a filling port 38 into a crucible 40, preferably made of a refractory material such as ceramic. An induction furnace 42 is preferably used for melting the metal 14 within the crucible 40 and insulation 44 is disposed between the induction furnace and the walls 39 of the pressure vessel 36. The melt chamber 12 is preferably connected to evacuating means 33 so that the metal 14 can be more effectively melted in a vacuum. This increases the purity and decreases the porosity of the melted metal 14. A view port 46 is provided for viewing the inside of the crucible 40.

The connecting means 32 preferably comprises a melt passage 48 fluidically connecting a hole 41 within crucible 40 with the valve element 50 which is preferably comprised of zirconium and is of the ball-type valve known in the industry for controlling the flow of metal. A plunger 52, comprised of ceramic or the like, is used for sealing and opening the hole 41.

Figure 6:
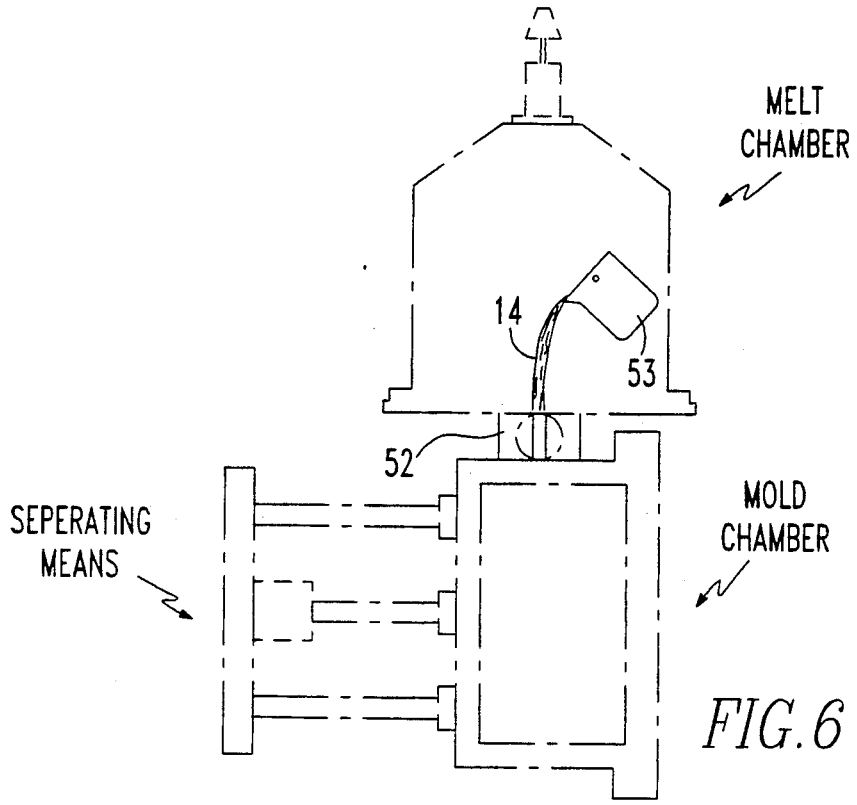
FIG. 6 shows the melt chamber with a tilting crucible which contains the metal.
Figure 7:
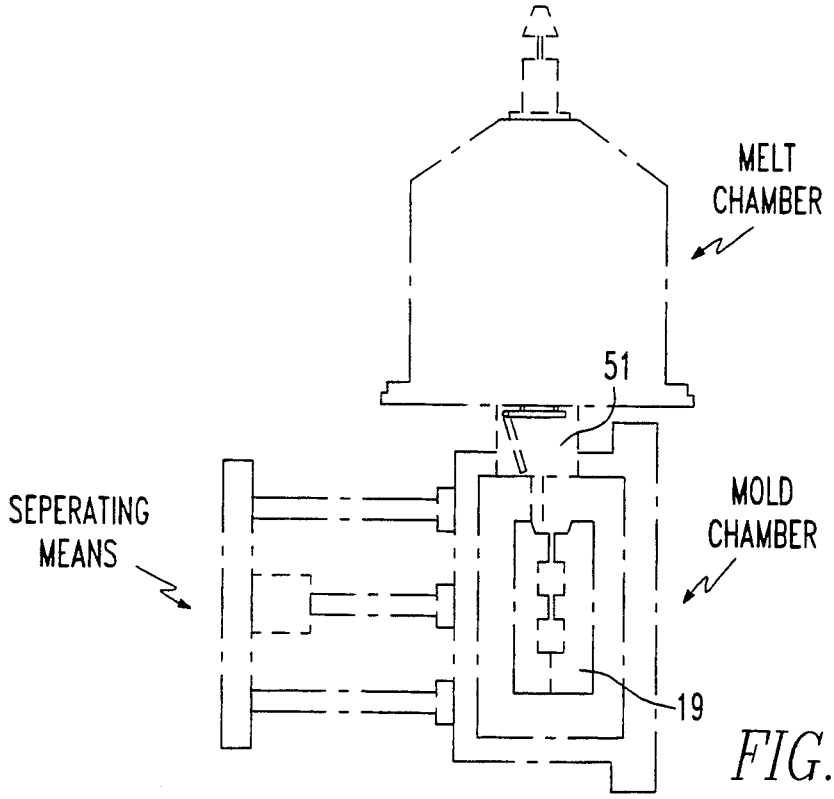
FIG. 7 shows the valve element as a gate valve.

Alternatively, as shown in FIG. 6, the melt chamber 12 comprises a tilting crucible 53 for containing the metal. The crucible 53 upon tilting pours the metal 14 into the fluidic connecting means 32. Alternatively, the valve element 50 can be comprised of a gate valve 51 as shown in FIG. 7.

In another alternative embodiment, molten metal can be prepared remotely and introduced into the mold chamber 18. The mold chamber 18 is then sealed. Or the melt chamber and the mold chamber are disposed in one pressure vessel, and they are fluidically connected so the melted metal from the mold chamber 12 flows to the riser cavity 28 of the mold 19. In this way, the valve element 50 is eliminated from the apparatus 10.

Referring back to FIG. 1, the bottom of the valve element 50 is fluidically connected to a mold passage 54 which extends into the riser cavity 28 defined within the mold 19. The mold chamber 18 is constructed of a mold pressure vessel 56 which preferably has a quick actuating locking ring 58 to release a head 59. Such a lock ring 58 can be a Harris quick release door. Preferably, there is heating means 60 disposed around the mold 19. The heating means 60 should provide enough heat to maintain the metal in a melted state. Means for directionally solidifying the metal is preferably disposed in thermal contact with the bottom of the mold 19. Preferably, the directional solidifying means includes a water cooled chill member 62 comprised of a thermally conductive material, such as copper.

As shown in FIG. 2, the separating means preferably includes a release piston 64 for opening the head 59 of the mold vessel 56 and to separate the mold halve 22 from mold halve 20. Preferably, the mold halve 22 is secured to the head 59 such that movement of the release piston 64 moves the head away from the vessel while separating the mold halves 20, 22. An ejector piston 66 is fixedly attached to the mold halve 20 for pushing the metal therefrom with ejector pins 68. Preferably, the mold halves are coated with a release agent so that the solidified metal part can be more easily removed from the mold halves 20, 22.

It should be noted that mold 19 or mold halves 20, 22, having thin walls, for instance, 0.020 inches thick can be used since the pressure on the inside of the mold 19 is never greater than the pressure on the outside of the mold 19. By controlling the pressurization rate, the pressure within the mold 19 can be allowed to approach the pressure on the outside of the mold. Further, if separable mold halves 20, 22 are used, they are forced together during the casting process under the action of the pressurization means 34.

Figure 3:
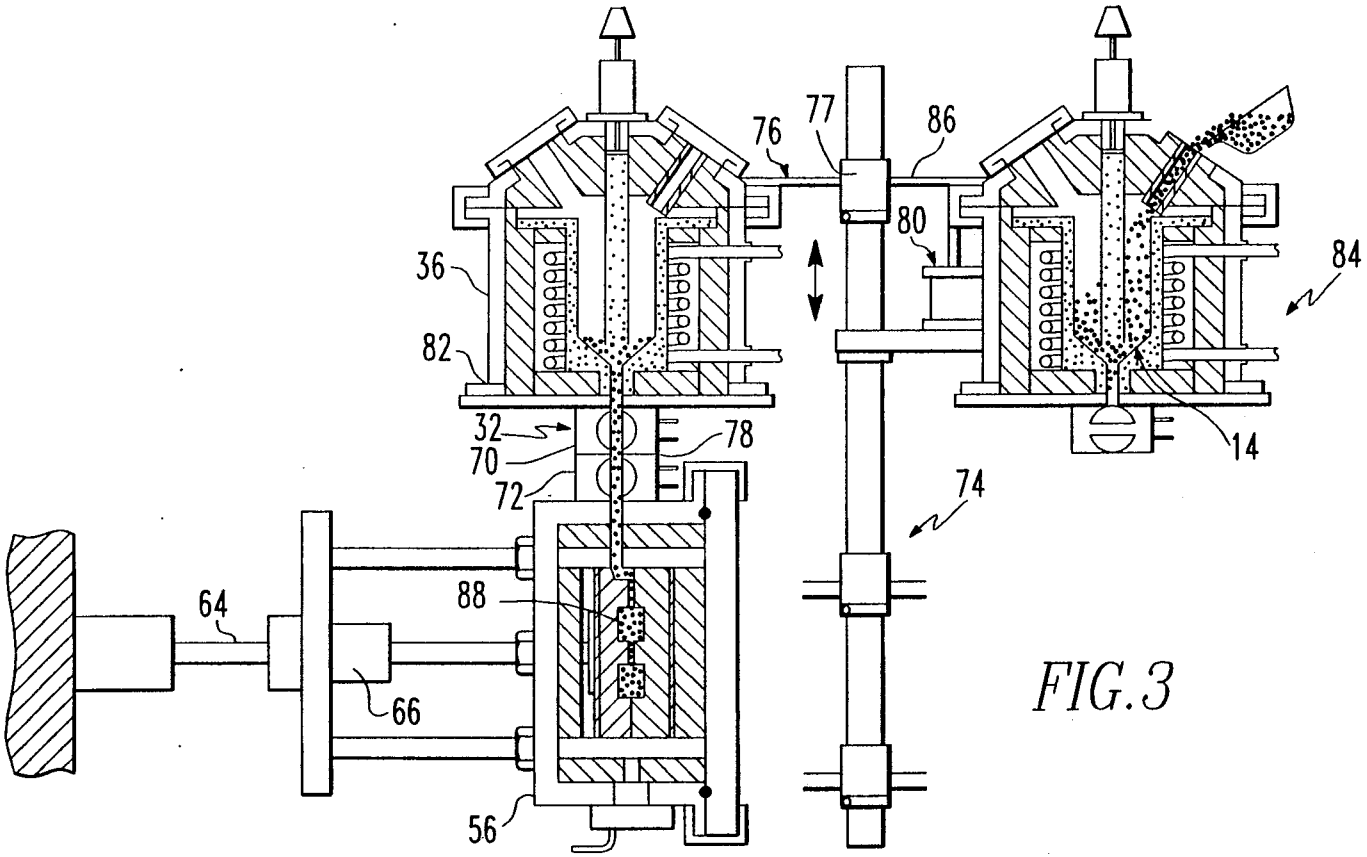
FIG. 3 shows a partial cross sectional view of the apparatus for casting mounted on a swing pole arrangement.

In a preferred embodiment and as shown in FIG. 3, the valve element 50 is comprised of a melt valve 70 attached to the melt vessel 36 and a mold valve 72 fixedly attached to the mold vessel 56. There is also means 78 to fluidically connect and seal the melt valve to the mold valve. The melt vessel 36 is rotatably secured to a vertically oriented swing pole 74 with swing arm 76 and bushing 77. The melt vessel 36 is mounted to the swing pole 74 above the mold vessel 56. In this manner, the melt vessel 36 can swing onto and away from the mold vessel 56. Sealing means 78 is used to seal the melt valve 70 to the mold valve 72 once they have been properly aligned. Preferably, the swing pole 78 comprises a swing pole piston 80 used to raise and lower the melt vessel 36 onto the mold vessel 56. The sealing means 78 is preferably comprised of a o-ring seal 82 to form a pressure tight seal.

The swing pole arrangement, as shown in FIG. 3, allows a plurality of melt vessels to be used with a single mold vessel 56. A second melt vessel 84 is shown rotatably mounted on the swing pole 74. Preferably, the second melt vessel 84 is identical to the melt vessel and is mounted to bushing 77 with second arm 86, such that a single swing pole piston 80 can be used to raise both the melt vessels 36, 84. FIG. 3 shows the second melt vessel 84 being loaded with metal 14 while the melted metal 12 within the melt vessel 36 is being used to cast a metal matrix component 88.

Figure 4:
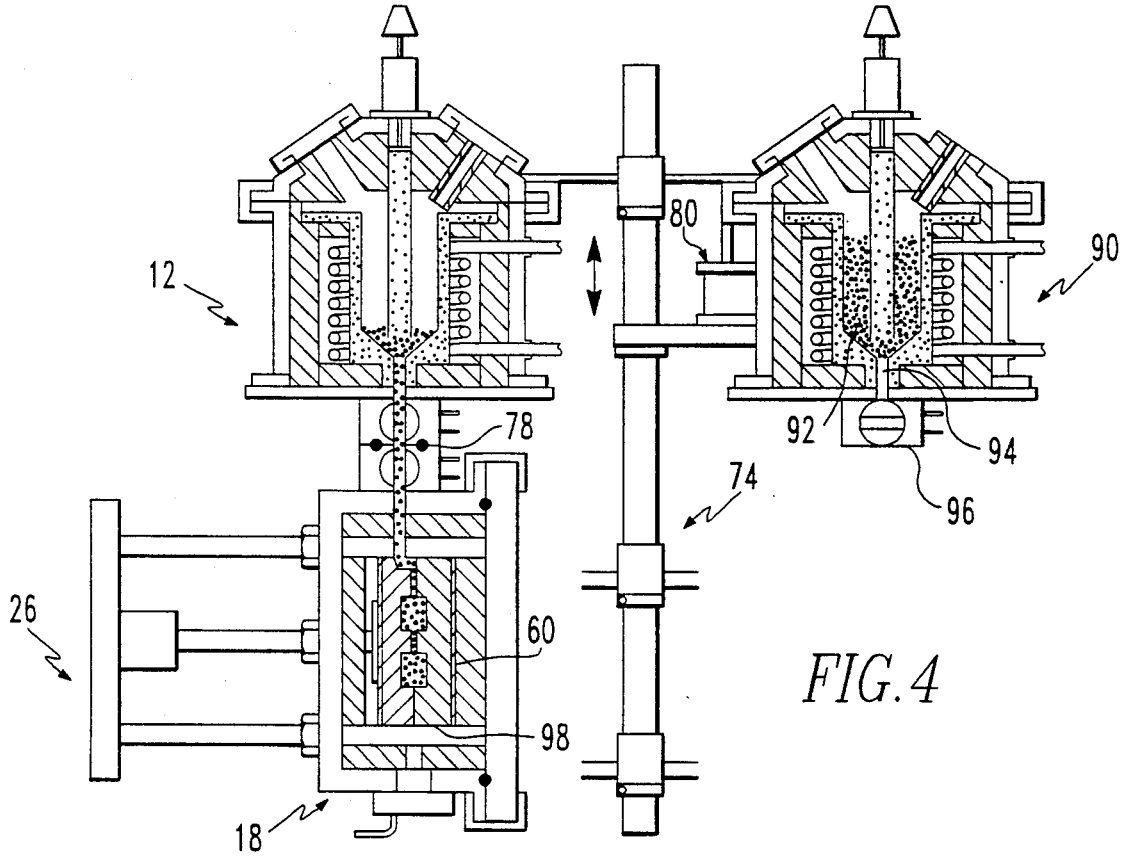
FIG. 4 shows a partial cross sectional view of the apparatus having a preform chamber mounted in the swing pole arrangement.
Figure 8:
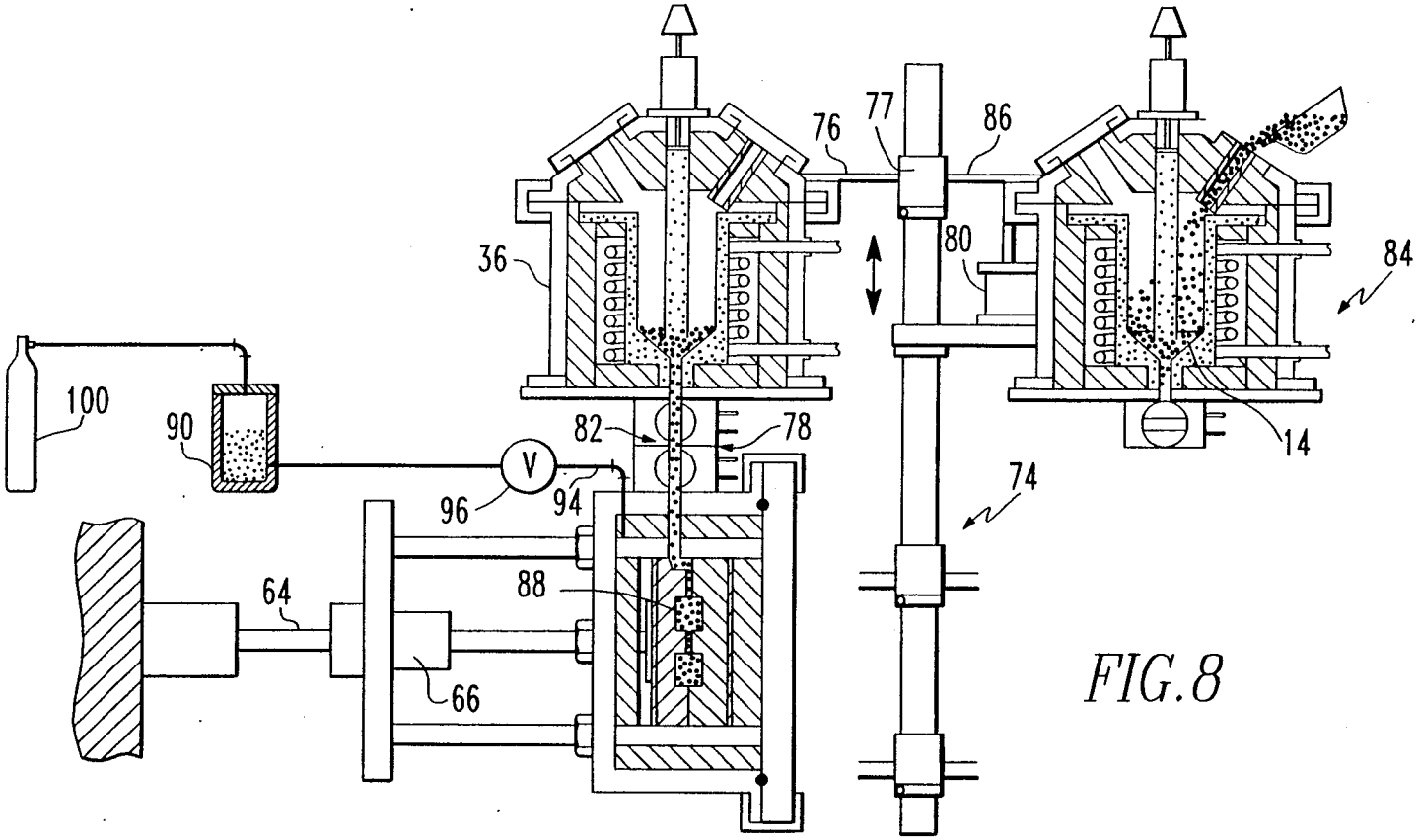
FIG. 8 shows the preform chamber fixedly attached to the mold chamber.

In an alternative embodiment, the apparatus 10 for casting metal matrix composites comprises a preform chamber 90 which loads the mold cavity 22 with preform mixture 92. In this manner, the preform does not have to be manually placed within the mold cavity each time a production run is performed. The preform chamber 90 includes a preform passage 94 through which the preform mixture 92 can flow from the preform chamber 90. A preform valve 96 is provided for fluidically opening and sealing the passage 94. In a first embodiment and as shown in FIG. 4, the preform chamber 90 is disposed above the mold chamber 18 and is rotatably connected to the swing pole 74 such that the preform chamber 90 can swing into proper alignment with the mold chamber 18 and a preform valve 96 can be sealed against the mold valve 72 with sealing means 78. In a second embodiment and as shown in FIG. 8, the preform chamber 90 is fixedly attached to the mold chamber 18 such that the preform passage 94 feeds directly into the riser cavity 28. There is also included means 100 to inject the preform mixture 92 into the riser cavity 28. Preferably, the means 100 for injecting the preform mixture 92 comprises a container containing pressurized gas which forces the preform mixture 92 into the preform passage 94. Previous to casting, the preform mixture 92 is loaded into the mold cavity 24. Preferably, the preform mixture 92 is comprised of reinforcement, a liquid flow medium and a binder. Once loaded, the heating means 60 heats the mixture 92 such that the liquid flow medium is removed from the mold cavity 24 and the binder sinters the reinforcement into a solid preform.

The present invention also pertains to a method of casting metal matrix composites. The method comprises the steps of first loading a melt chamber 12 with metal 14. Then, there is the step of evacuating the melt chamber and the mold chamber. The melt chamber 12 includes means 16 for melting the metal and is fluidically connected to a valve element 50 for opening and sealing a passage between the melt chamber 12 and a mold chamber 18. The mold chamber 18 is disposed below the melt chamber 12 and includes a mold 19 defining a mold cavity 24 containing a preform 30. During this step, the valve element 50 is closed. Next, there is the step of melting the metal 14 within the melt chamber 12. Then, there is the step of fluidically connecting the melt chamber 12 to the mold chamber 18 with the valve element 50 such that a charge of metal 14 flows into a riser cavity 28. Next, there is the step of fluidically sealing the valve element 50 to fluidically seal the melt chamber 12 from the mold chamber 18. Then, there is the step of pressurizing the mold chamber 18 such that the melted metal 14 is forced down into the mold cavity 24 to infiltrate the preform 30. Finally, there is the step of separating the metal from the mold.

Preferably, the mold is comprised of separable mold halves and the removing step includes the step of separating the mold halves with separating means such that the metal and preform is ejected from the mold halves.

Preferably, the mold chamber 18 includes a chill plate 62 in thermal contact with the bottom of the mold halves 20, 22 and before the separating step, there is the step of cooling the bottom 98 of the separable mold halves such that the melted metal 14 is directionally solidified. Preferably, before the melting step, there is the step of evacuating the melt chamber 12.

Figure 5A:
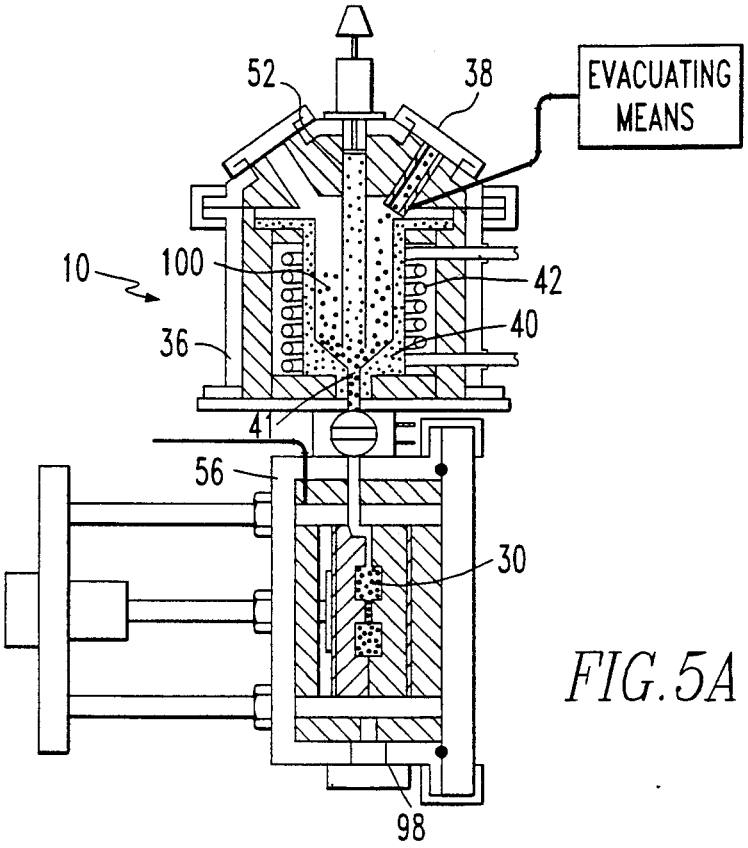
FIGS. 5*a*–5*f* show a method for the production of metal matrix composites.
Figure 5B:
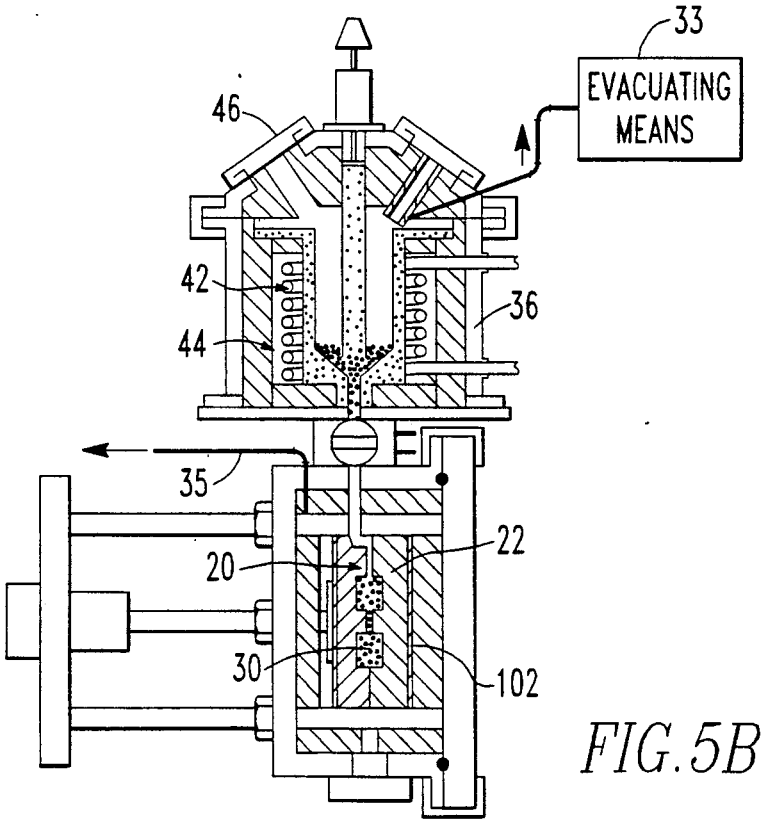

In the operation of the apparatus 10 and as shown in FIG. 5*a* aluminum 110 is loaded through filling port 38 into a crucible 40 comprised of ceramic. The plunger 52, also comprised of ceramic, seals the hole 41. The melt pressure vessel 36 is then evacuated to remove all the gas therein. The aluminum 110 is next heated, as shown in FIG. 5*b*, with induction furnace 42 to a temperature of 650° C. to melt the aluminum 110. Insulation 44 insulates the water cooled melt vessel 36 from the heat. The melting process can be seen through a view port 46 located on top of the melt pressure vessel 36.

Figure 5C:
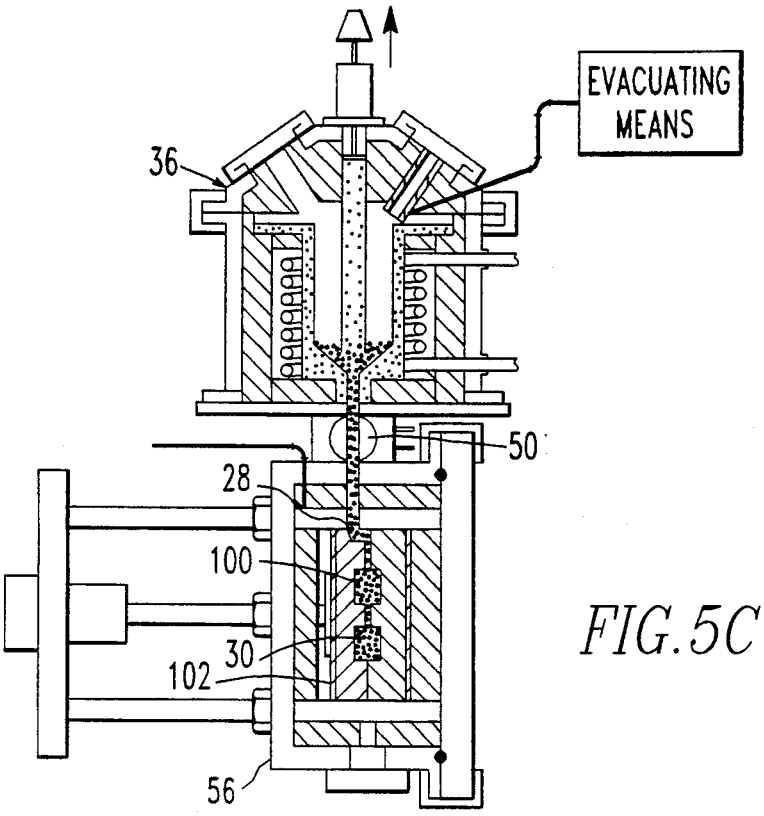

Meanwhile, the mold pressure vessel 56 is also evacuated. By evacuating the vessel 36 and the mold cavity 24, there is less chance of voids being formed after the aluminum 110 has entered the preform 30. The separable mold halves 20, 22 and preform 30 are heated to a temperature of 700° C. with resistive heating elements 102. The preform is comprised of SiC whiskers having a volume fraction of 70%. The mold halves 20, 22 are comprised of alumina and are coated with Grafoil ®, a mold sealant. After both vessels have been evacuated and the aluminum, mold halves 20, 22 and preform 30 are heated, the ball valve 50, which is comprised of zirconium, is opened, as shown in FIG. 5*c*, to fluidically connect the melt vessel 36 with the mold vessel 56.

The plunger 52 is then lifted to allow a charge of melted aluminum 110 to flow through the ball valve 50 and into the riser cavity 28. The aluminum 100 remains melted, as the riser cavity 28 is heated by the resistive heating elements 102 the plunger is then closed to stop the flow of aluminum 100 and the ball valve 50 is closed to seal the mold vessel 56 from the melt vessel 36. The melted aluminum 100 in the riser cavity 28 covers the mold cavity 24 thereby fluidically isolating it from the interior of the mold vessel 56.

Figure 5D:
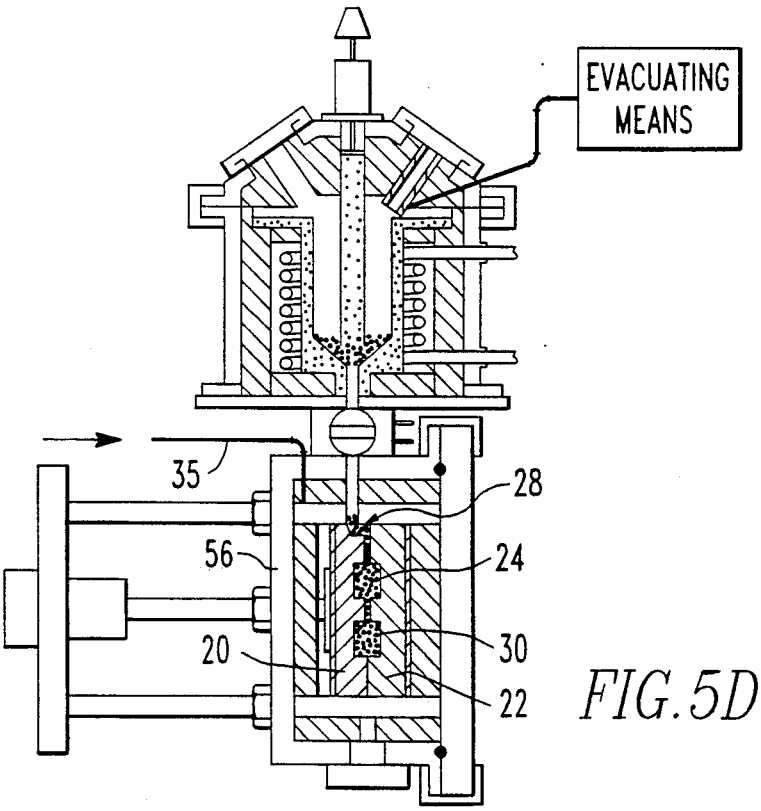

Once the ball valve 50 has been closed, the pressurization means 34 introduces pressurized nitrogen gas into the mold vessel 56, as shown in FIG. 5*d*. The pressure in the mold vessel 56 is consequently increased throughout and specifically at the surface of the melted aluminum in the riser cavity 28. As the melted aluminum in the riser cavity 28 prevents the pressurized gas in the mold vessel 56 from reaching the mold cavity 24 since the interior of the mold cavity 24 is fluidically isolated from direct communication with the interior of the mold vessel 56, a pressure differential is created between the interior of the vessel 56 and the mold cavity 24. This pressure differential results in the melted aluminum 100 being forced down into the mold cavity 24, as shown in FIG. 5*d*. The amount of melted aluminum that is forced into the mold cavity 24 and consequently the preform 30 corresponds to the amount of pressure in the mold vessel 56 at the surface of the melted aluminum 110. The more pressure in the vessel, the more aluminum 110 is forced into the preform 30 to compensate for the difference in the pressure between the mold cavity 24 and the inside of the mold vessel 56.

As the aluminum is forced into the preform 30, the pressure is equalized between the mold cavity 24 and the inside of the mold vessel 56 itself. By controlling the pressurization rate, it is possible to control the difference between the pressure on the inside and outside of the mold halves 20, 22. The slower the rate, the lower the pressure differential and so a thinner or lower strength wall thereof is required. Quick pressurization rates require heavy walls to withstand the pressures exerted on the walls of the mold halves 20, 22.

Figure 5E:
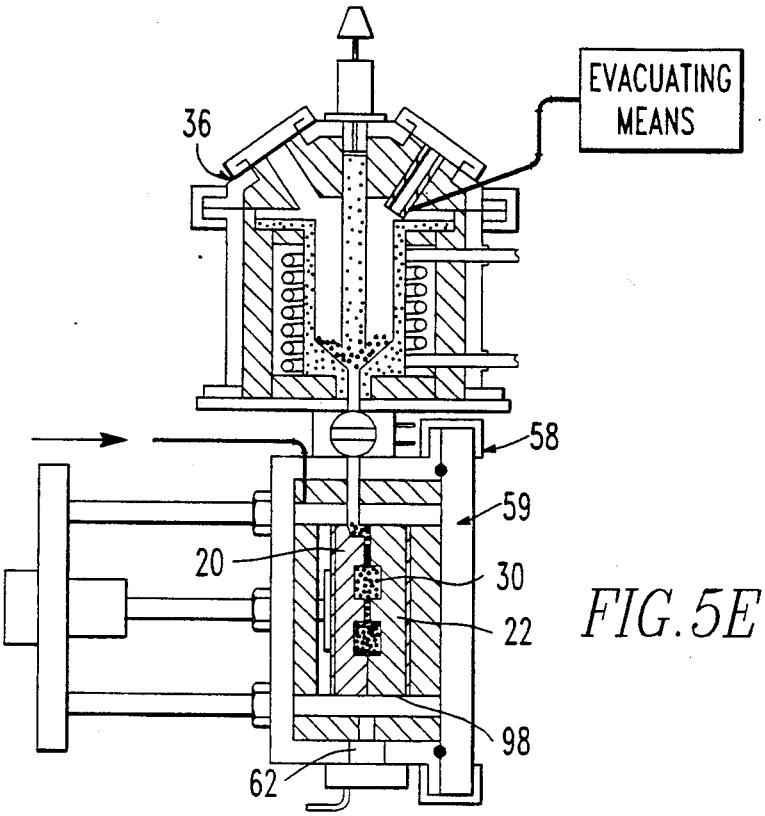

As shown in FIG. 5*e*, after the preform is infiltrated, water is circulated to a copper chill member 62 which is in thermal contact with the bottom 98 of the mold halves 20, 22. The pressure remains on as the aluminum 110 is directionally solidified from the bottom up. Since the aluminum 110 as it solidifies contracts, it is necessary for the pressurization to remain on so that the molten aluminum 110 will fill any voids left behind during contraction.

Figure 5F:
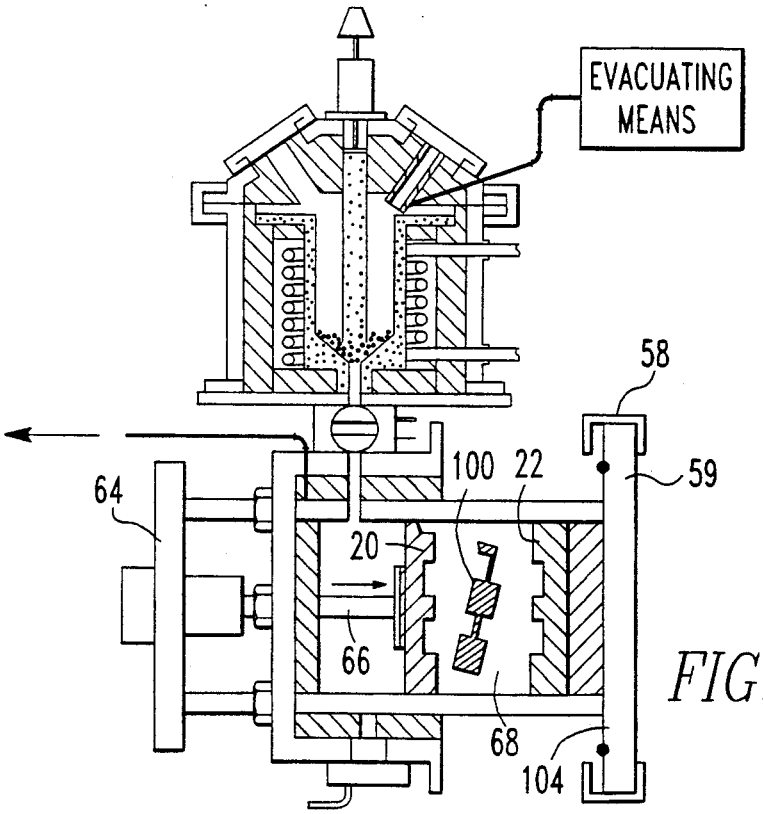

As shown in FIG. 5*f*, the mold vessel 56 is first vented and the quick release head 59 is released by turning the locking ring 58. The head 59 is sealed to the mold vessel 56 with high temperature Viton® seals 104. The release piston 64 is then actuated to separate the head 59 and locking ring 58 from the mold vessel 56. The right mold half 22 is fixedly attached to the head 59 and therefore the separating piston also separates the mold halves 20, 22. Ejector piston 66 is then actuated to push ejector pins 68 into the solidified aluminum 110 to eject it from the left mold half 22. A release agent facilitates the aluminum 110 to release from the mold halves 20, 22.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. An apparatus for casting metal matrix composites comprising:

a melt chamber within which a metal is disposed, the melt chamber includes means for melting the material;

a mold chamber disposed beneath the melt chamber, a mold defining a mold cavity within the melted metal is formed and a preform is disposed and a riser cavity fluidically connected to the mold cavity for holding a charge of melted metal, said mold disposed within the mold chamber;

means for fluidically connecting the melt chamber to the mold chamber, said connecting means in communication with the melt chamber and the mold chamber; a valve element disposed in the connecting means such that when the valve is closed, the chambers are fluidically isolated and when the valve element is opened, the chambers are fluidically connected and the melted metal can flow from the melt chamber into the mold chamber, said valve element is mechanical and can be positioned in a closed orientation or an open orientation;

means for evacuating the mold chamber, said evacuating means in communication with the mold chamber; and means for pressurizing the mold chamber such that the melted metal disposed within the riser cavity is forced into the mold cavity to infiltrate the preform.

2. An apparatus as described in claim 1 wherein the mold is comprised of separable mold halves which define the mold cavity and the mold chamber comprises means to mechanically separate the separable mold halves such that the metal and preform within the mold cavity are ejected from the separable mold halves.

3. An apparatus as described in claim 2 wherein the mold chamber comprises means for directionally solidifying the melted metal within the mold cavity.

4. An apparatus as described in claim 3 wherein the directional solidifying means includes a chill member which is in thermal contact with the bottom of the separable mold halves.

5. An apparatus as described in claim 4 comprising means for evacuating the melt chamber which is in communication with the melt chamber.

6. An apparatus as described in claim 5 wherein the melt chamber includes a tilting crucible for containing the metal, said crucible upon tilting pours the melted metal into the connecting means.

7. An apparatus as described in claim 5 wherein the melt chamber includes a crucible for containing the metal, a plunger for sealing a hole within the crucible and means for lifting the plunger such that metal can flow from the crucible and into the fluidic connection means.

8. An apparatus as described in claim 7 wherein the melting means includes induction coils.

9. An apparatus as described in claim 8 wherein the mold chamber includes a quick release head and the separating means includes a release piston for separating the head from the mold chamber and for separating the mold halves, the separating means further includes an ejector piston for pushing the metal from a mold half with ejector pins.

10. An apparatus as described in claim 9 wherein a mold sealant is disposed between the separable mold halves to enhance the seal therebetween.

11. An apparatus as described in claim 10 wherein the mold chamber includes a port, and the evacuation means and the pressurization means are in communication with that port.

12. An apparatus as described in claim 11 wherein the mold chamber includes means for heating the separable mold halves.

13. An apparatus as described in claim 12 wherein the valve element is comprised of a ball valve.

14. An apparatus as described in claim 12 wherein the valve element is comprised of a gate valve.

15. An apparatus as described in claim 12 wherein the valve element includes a melt valve attached to the melt chamber, a mold valve attached to the mold chamber; and means to fluidically connect and seal the melt valve and mold valve, said melt chamber is rotatably secured to a vertically oriented swing pole such that the melt valve can be swung into proper alignment with the mold valve and sealed there against with sealing means.

16. An apparatus as described in claim 15 wherein a plurality of melt chambers having melt valves are rotatably connected to the swing pole.

17. An apparatus for casting metal matrix composites comprising:

a melt chamber within which a metal is disposed, the metal chamber includes means for melting the metal, a melt passage through which the metal can flow from the melt chamber and a melt valve for controlling the flow of metal through said melt passage;

a preform chamber within which a liquid preform mixture is disposed, the preform chamber includes a preform passage through which the preform mixture can flow from the preform chamber and a preform valve for controlling the flow of preform from the preform passage;

a mold chamber comprised of a mold passage through which the preform mixture and metal can flow from their respective chambers and a mold valve disposed within the mold passage such that when the mold valve is closed, the mold chamber is fluidically isolated and when the mold valve is open, the preform mixture and melted metal can flow through the mold passage, said mold valve is mechanical and can be positioned between a closed orientation and an open orientation;

a mold defining a mold cavity within which the preform mixture and the metal are formed and a riser cavity fluidically connected to the mold cavity for holding the melted metal, said mold disposed within the mold chamber;

means for evacuating the mold chamber, said evacuating means in communication with the mold chamber;

means for fluidically sealing the melt valve to the mold valve;

means for pressurizing the mold chamber such that the melted metal is forced into the mold cavity; and said melt chamber disposed above the mold chamber and is rotatably connected to a swing pole such that the melt valve can be swung into proper alignment with the mold valve and sealed thereagainst with the sealing means.

18. An apparatus as described in claim 17 wherein the preform chamber is disposed above the melt chamber and is rotatably connected to the swing pole such that the preform valve can be swung into proper alignment with the mold valve and sealed thereagainst with the sealing means.

19. An apparatus as described in claim 18 wherein the preform chamber is fixedly attached to the melt chamber such that the preform passage feeds directly into the riser cavity and the preform chamber includes means to inject the preform into the riser cavity.

20. An apparatus as described in claim 17 wherein the mold is comprised of separable mold halves which define the mold cavity and the mold chamber comprises means to mechanically separate the separable mold halves such that the metal and preform within the mold cavity is ejected from the separable mold halves.

21. An apparatus as described in claim 20 wherein the mold chamber comprises means for directionally solidifying the melted metal within the mold.

22. An apparatus as described in claim 21 wherein the directional solidifying means includes a chill member in thermal contact with the bottom of the separable mold halves.

23. An apparatus as described in claim 18 wherein the preform chamber and melt chamber are connected to the swing pole on a rotatable arm and the swing pole includes means to raise and lower the arm such that when the preform valve and melt valve are in alignment with the mold valve, they can be lowered thereon and sealed thereagainst with said sealing means.

24. An apparatus as described in claim 23 wherein the raising and lowering means includes a piston.

25. An apparatus as described in claim 17 comprising means for evacuating the melt chamber.

26. An apparatus for casting metal matrix composites comprising:

a melt chamber within which a metal is disposed, the melt chamber includes means for melting the material;

a mold chamber disposed beneath the melt chamber;

a mold defining a mold cavity within which the melted metal is formed and a riser cavity fluidically connected to the mold cavity for holding a charge of melted metal, said mold disposed within the mold chamber;

means for fluidically connecting the melt chamber to the mold chamber, said connecting means in communication with the melt chamber and the mold chamber; a valve element disposed in the connecting means such that when the valve is closed, the chambers are fluidically isolated and when the valve element is opened, the chambers are fluidically connected and the melted metal can flow the melt chamber into the mold chamber, said valve element is mechanical and can be positioned in a closed orientation or an open orientation, said valve element includes a metal valve attached to the melt chamber, a mold valve attached to the mold chamber and means to fluidically connect and seal the melt valve and mold valve, said melt chamber rotatably secured to a vertically oriented swing pole such that the melt chamber can be swung into proper alignment with the mold chamber and sealed thereagainst with the sealing means;

means for evacuating the mold chamber, said evacuating means in communication with the mold chamber; and means for pressurizing the mold chamber such that the melted metal disposed within the riser cavity is forced into the mold cavity.

27. An apparatus as described in claim 26 wherein a plurality of metal chambers are rotatably connected to the swing pole.

28. An apparatus for casting metal matrix composites comprising:

a melt chamber within which a metal is disposed, the melt chamber includes means for melting the metal, a melt passage through which the metal can flow from the melt chamber and a melt valve for controlling the flow of metal through said melt passage;

a reinforcement chamber within which a liquid reinforcement mixture is disposed, the reinforcement chamber includes a reinforcement passage through which the reinforcement mixture can flow from the reinforcement chamber and a reinforcement valve for controlling the flow of reinforcement from the reinforcement passage;

a mold chamber comprised of a mold passage through which the reinforcement mixture and metal can flow from their respective chambers and a mold valve disposed within the mold passage such that when the mold valve is closed, the mold chamber is fluidically isolated and when the mold valve is open, the reinforcement mixture and melted metal can flow through the mold passage, said mold valve is mechanical and can be positioned between a closed orientation and an open orientation;

a mold defining a mold cavity within which the reinforcement mixture and the metal are formed and a riser cavity fluidically connected to the mold cavity for holding the melted metal, said mold disposed within the mold chamber;

means for evacuating the mold chamber, said evacuating means in communication with the mold chamber;

means for fluidically sealing the melt valve to the mold valve;

means for pressurizing the mold chamber such that the melted metal is forced into the mold cavity; and said melt chamber disposed above the mold chamber and is rotatably connected to a swing pole such that the melt can be swung into proper alignment with the mold valve and sealed thereagainst with the sealing means, said reinforcement chamber disposed above the melt chamber and rotatably connected to the swing pole such that the reinforcement valve can swing into proper alignment with the mold valve and sealed thereagainst with the sealing means.

29. An apparatus as described in claim 28 wherein the reinforcement chamber includes means to inject the reinforcement into the riser cavity.

30. An apparatus as described in claim 29 wherein the reinforcement chamber and melt chamber are connected to the swing pole on a rotatable arm and the swing pole includes means to raise and lower the arm such that when the reinforcement valve and melt valve are in alignment with the mold valve, they can be lowered thereon and sealed thereagainst with said sealing means.

31. An apparatus as described in claim 30 wherein the raising and lowering means includes a piston.

* * * * *